United States Patent [19]

Wilcox et al.

[11] 4,191,083

[45] Mar. 4, 1980

[54] METHOD AND APPARATUS FOR MEMORIZING AN ACCOMPANIMENT PASSAGE

[75] Inventors: Brian N. Wilcox, Jasper; Melvin J. Schroeder, Ferdinand; Billy J. Whittington; John W. Robinson, both of Jasper, all of Ind.

[73] Assignee: Kimball International, Inc., Jasper, Ind.

[21] Appl. No.: 930,394

[22] Filed: Aug. 2, 1978

[51] Int. Cl.[2] ..... G10H 1/00

[52] U.S. Cl. ..... 84/1.28; 84/1.03; 84/1.17; 84/DIG. 12; 84/DIG. 22

[58] Field of Search ..... 84/1.01, 1.03, 1.17, 84/1.28, DIG. 12, DIG. 22

[56] References Cited

U.S. PATENT DOCUMENTS

| | | | |
|---|---|---|---|
| 3,889,568 | 6/1975 | Amaya | 84/1.01 |
| 3,890,871 | 6/1975 | Oberheim | 84/1.01 |
| 3,990,339 | 11/1976 | Robinson et al. | 84/1.03 |
| 4,072,078 | 2/1978 | Shallenberger et al. | 84/DIG. 22 |
| 4,078,465 | 3/1978 | Wheelwright | 84/1.01 |
| 4,108,037 | 8/1978 | Robinson et al. | 84/1.03 |
| 4,112,802 | 9/1978 | Robinson et al. | 84/1.01 |
| 4,120,225 | 10/1978 | Dietrich et al. | 84/1.03 |
| 4,129,055 | 12/1978 | Whittington et al. | 84/1.01 |

*Primary Examiner*—B. Dobeck
*Assistant Examiner*—William L. Feeney
*Attorney, Agent, or Firm*—Albert L. Jeffers; John F. Hoffman

[57] ABSTRACT

A method and apparatus for memorizing and playing back an accompaniment passage in an electronic organ wherein the keyboard is multiplexed to develop a serial input data stream having keydown signals in the time slots corresponding to the depressed keys, selectively writing into a programmable random access memory data corresponding to the absolute address of the first occurring keydown signal in the pulse train and then writing into the memory data corresponding to the intervals, expressed in terms of time slots in the multiplexed data stream, between a number of the first occurring keydown signals, beginning with the first occurring signal. The data is read out of the memory and converted to a serial time division multiplexed data stream by means of comparators which produce a pulse each time there is a compare condition between the output of the memory and the count produced by the master counter/subcounter. The serial data stream is then demultiplexed so as to isolate the appropriate keyers to produce the tones selected by the keys depressed during the record mode.

16 Claims, 5 Drawing Figures

HF CLOCK
FROM MASTER COUNTER
A STROBE
B DECODER
226
φ4
φ3
φ2
φ1

120
94
DIN
RAM
D OUT
R/W
A1 A2 A3 A4 A5
A B C D E
182
122
96
D IN
D OUT
90
128
188
186
124
98
192
108
190
RAW DATA IN
106
END OF SCAN
174
184
180
178
182
176
130
TO 140
114
100
G.
H.
I.
92
115
102
126
142
EOS
CK E LD
COUNTER
172
168
118
113
PRE
F/F
CK CL
116
104
J.
K.
22
L.
M.
N.
O.
P.
Q.
68
QA QB QC QD
LD
CK
A B C D
CL
170
112
110
74
RHYTHM CLOCK
A.
B.
C.
D.
E.
F.
162

FROM MASTER COUNTER
H G F
194
COMP B
A=B
A.
B.
C.
214
216
200
202
TO DEMUX
198
220
160
208
F/F
D
Q
CK
CL
210
F/F
212
VCC
DOWNBEAT IN
F/F
86
PRE
RECORD BUTTON
16
138
206
204
74
MEASURE COUNTER
CK
LD
QD QC QB QA
CL
222
76
READY=0
F/F
PLAYBACK=0
FROM 142
136
140
82
80
84
D.
E.
F.
158
F/F
134
144
φ4
156
218
RECORD =0
88
G.
SEQ CTR
QD
QC
QB
QA
R1 R2
132
H.
I.
VCC
PRE
148
F/F
164
φ3
φ̄1
154
166
150
152
A=B OUT
COMP. A
J.
K.
QD
QC
QB
QA
SUB COUNTER
CL
CK
L.
M.
N.
O.
P.
Q.
J
K
CK
CL
72
NML
B
146
FROM MASTER COUNTER
VCC
RHYTHM COUNT I

METHOD AND APPARATUS FOR MEMORIZING AN ACCOMPANIMENT PASSAGE

BACKGROUND OF THE INVENTION

The present invention relates to means for memorizing an accompaniment passage and then playing back the passage whenever desired by the performer.

To store the absolute address for each note of the keyboard would require a full six bit word, in the case of a sixty-one note manual, and to store a four note chord, then four times as much storage capacity would be required, thereby resulting in a rather expensive and inefficient system to perform the desired function. Such capacity is not necessary, however, because it is not possible for the player to span the entire keyboard when playing a single accompaniment chord without using two hands and, from a practical standpoint, the occasion for playing such a chord would be quite rare in normal musical compositions.

The system of the present invention relies on the principle that starting with the highest note played in the accompaniment, the next note lower will not be greater than seven notes away and no note will be more than seven notes away from the notes on either side of it.

SUMMARY OF THE INVENTION

The function of the system according to the present invention is to memorize a two measure accompaniment passage comprising four note or less chords, and then play back the passage whenever desired. The term "chord" in this application means any combination of notes played simultaneously without regard to any rules of harmony. Each measure is broken down into sixteenth note segments under the control of the rhythm clock thereby enabling the player to play thirty-two different chords during the two measure period.

The keyboard is divided into eight segments each comprising eight or less successive keys. In a sixty-one note manual, for example, the first seven segments will contain eight notes and the last segment will contain only five. The system comprises a pair of random access memory blocks, the first of which stores data corresponding to the segment in which the highest note of the chord is located for each of the thirty-two rhythm beats. The second random access memory block stores data which precisely locates the first note in the segment and also stores data identifying the interval, expressed in terms of successive notes, between the highest note and the second highest note, between the second highest note and the third highest note, and between the third highest note and the fourth highest note. By utilizing this scheme, the total size of the random access memory is greatly reduced without placing undue limitations on the capabilities of the system.

As discussed above, the primary limitation which is imposed is that the performer cannot play any chord wherein the interval between adjacent notes is greater than seven notes. In the event the player inadvertently plays a combination of notes with any two notes having an interval greater than seven notes apart, those notes which lie below the interval will not be recorded. Those notes above the interval will be recorded in the normal fashion. This situation is not often encountered under normal circumstances.

In operation, the player depresses a momentary record button, at which time a "ready" light comes on and remains on for two rhythm measures. At that point, the record light comes on and whatever is played during the next two measure record sequence is stored in the memory. At the end of that two measure record period, the playback light will come on and, if the output data is gated to the output circuitry, a replay of the recorded passage will be heard.

The present invention is concerned with an electronic organ having a keyboard with playing keys and a multiplexer for scanning the keyboard and developing a multiplexed serial input data stream having keydown signals in time slots corresponding to depressed keys of the keyboard, the improvement being a programmable note pattern generator having a record mode and a playback mode and comprising: a counter for producing a count sequence in synchronism with the scanning of the keys of the keyboard, a programmable memory, record means responsive to the input data stream for writing into the memory data corresponding to the keydown signals therein when the generator is in the record mode, playback means for reading the data stored in the memory in the same order in which it was written therein, and comparator means for producing a keydown signal in an output data stream each time there is a match between the count and the data read out of the memory.

The present invention also relates to a method of memorizing and then playing back a musical passage in an electronic organ comprising the steps of: depressing a plurality of keys on the keyboard, multiplexing the keyboard to develop a serial input data stream having a unique time slot for every key of the keyboard and a plurality of signals in time slots corresponding to the depressed keys, selectively writing into a programmable memory data corresponding to the location in the data stream of the first occurring keydown signal and then writing into the memory data corresponding to the respective intervals between at least some of the successively occurring keydown signals including the first occurring keydown signal, reading the data stored in the memory, converting the data read out of the memory to a serial time division multiplexed data stream having keydown signals in time slots uniquely corresponding to certain keys of the keyboard, and producing audible tones corresponding to said certain keys.

DETAILED DESCRIPTION

Figures 1, 2:
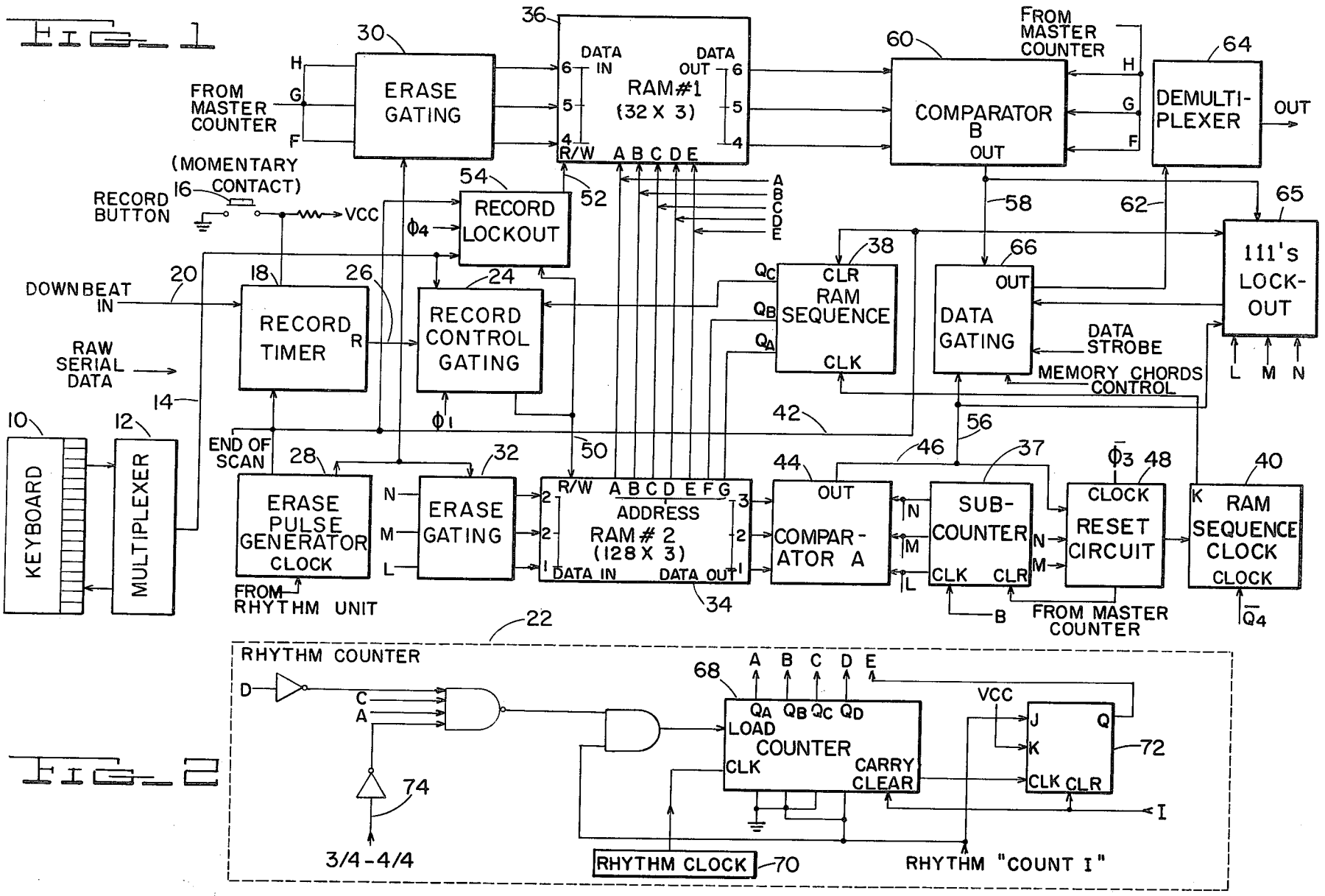
FIG. 1 is a simplified block diagram of the system according to the present invention.
FIG. 2 is a schematic diagram of the rhythm counter.

Referring now to the drawings and in particular to FIG. 1, keyboard 10 is scanned by multiplexer 12 which forms a serial data stream on line 14 comprising keydown pulses in time slots corresponding to the individual keys of keyboard 10. In order to store the informational content of the aforementioned data stream for selective playback by the organ, the system has three modes of operation: an erase mode, a record mode and a playback mode.

In order to record a two measure sequence of notes or chords, record button 16 is momentarily depressed which transmits a command to record timer 18 to wait for two measures before placing the system in the record mode. This is accomplished by counting downbeat signals on line 20, which may be generated through any suitable decoding of the rhythm counter 22 to provide a pulse in a time slot corresponding to the beginning of each new measure. When the third downbeat signal is received by record timer 18, a record signal is transmitted to record gating 24 over line 26. This period of delay enables the player to ready himself for recording the desired two measure passage.

The first end of scan (EOS) pulse received from multiplexer 12 after each rhythm clock leading edge is fed to erase pulse generator 28 which provides signals to erase gating circuits 30 and 32 thereby causing a binary 111 to be loaded into least significant bit random access memory 34 and a binary 000 to be loaded into most significant bit random access memory 36, when memories 34 and 36 receive the appropriate write signals from record control gating 24. This binary data denotes that no note is to be played and serves to erase RAMs 34 and 36 for the time frame corresponding to that beat (rhythm clock) of the measure.

Most significant bit RAM 36 serves to locate one of eight segments in which the highest note in the chord is located and is addressed by most significant bit outputs H, G and F from the master counter, which is a down counter counting from 63 to 0. For instance, on a sixty-one note manual, the first seven segments contain eight notes each and the last segment will contain only five. RAM 36 serves to locate this eight note segment for each of 32 rhythm beats. For example, if a chord is played on the accompaniment manual wherein the highest note of the chord is eight keys from the lower end of the keyboard, RAM 36 will store binary 001, which corresponds to the seventh segment down the keyboard. Similar storage will be accomplished for the chords which are played during the remaining thirty-two beats of the two rhythm measures.

Least significant bit RAM 34 stores three bit binary words relating to the absolute count of the three LSB's of the Master Counter bits C, D and E for the first note, and, for subsequent notes, the note interval between this subsequent note and the previous note. The subsequent binary words would denote the interval between the first note and the second note to be played, the interval between the second note and the third note to be played, and the interval between the third note and the fourth note to be played, in the case of a four note chord. The least significant bit RAM 34, when storing a binary 111, can convey one of two things, depending on the state of the other control blocks. If the MSB RAM 36 contains only 000 (the erased state), a binary 111 in the LSB RAM 34 means that no data is present and inhibits any data from being passed to the output data stream. If the MSB RAM 36 contains data other than 000, a binary 111 in LSB RAM 34 corresponds either to the interval of the last note from the preceding note, with no more notes being accepted for recording, or the first and only note for that rhythm beat of the measure, with no more notes being accepted for recording during that beat. In the event that a subsequent note is present for recording or playback, it will have no effect because the presence of a binary 111 in LSB RAM 34 combined with a number other than binary 000 in MSB RAM 36 sets a data disable command which prevents further recording or playback during that rhythm beat. Similar data is stored for each of the thirty-two rhythm beats.

Returning to the erase mode, the erase cycle lasts for one complete scan of the keyboard and is initiated by the leading edge of the pulse from the rhythm clock fed to erase pulse generator 28. Generator 28 also counts the number of end of scan (EOS) pulses received from multiplexer 12, for example, and transmits signals to erase gating circuits 30 and 32 after seventeen such EOS pulses have been counted thereby enabling the HGF bits from the master counter to pass to the data in inputs on RAM 36 and the least significant bits LMN from sub-counter 37 to pass to the data in inputs of RAM 34.

The manner in which RAM 34 is addressed, during both the erase and record cycles, is controlled by sequence control block 38, which is clocked by RAM sequence clock 40 and cleared by an end of scan pulse on line 42. RAM sequence clock 40 provides a pulse during the phase 4 time of each pulse provided by the master counter, and control circuit 38 sequences RAM 34 through each of its four sections (less than four sections if less notes are played) during the scan of the manual.

Sub-counter 37 counts from binary 000 to binary 111 during the erase mode and when comparator 44 sees binary 111 at the output of sub-counter 36, it provides a pulse on line 46 which indicates a compare condition because of the binary 111 word on the output of RAM 34 during the erase cycle. The compare pulse on line 46 causes reset circuit 48 to reset sub-counter 37 and also causes sequence control circuit 38 to address the next section of RAM 34.

In the record mode, which occurs seventeen manual scans after the erase scan for each of the thirty-two rhythm beats, erase gating 30 and 32 permits the master clock information HGF and the three bit binary word MNL from sub-counter 37 to be loaded into RAMs 36 and 34, respectively. This is accomplished by a write signal produced by record control gating circuit 24 on lines 50 and 52, the latter passing through record lock-out circuit 54. As the manual is scanned in synchronism with the master counter, a series of binary words is presented to the data in terminals of RAMs 34 and 36 when a keydown pulse appears in the data stream on line 14, a write pulse is transmitted to RAM 36 thereby causing the three bit binary word at its input at that time to be loaded. This word corresponds to the eight key segment which is being scanned at that time.

A similar write pulse is presented to LSB RAM 34 thereby causing comparator 44 to detect a match between the binary word at its one set of inputs, corresponding to the NML word at the input to erase gating circuit 32, and the binary word at its other input, the NML count produced by sub-counter 37. The compare pulse on line 46 causes circuit 48 to reset sub-counter 37 and increment the counter within the RAM sequence control block 38. The three bit word stored in the first section of LSB RAM 34 corresponds to the absolute address of the master counter.

When the second pulse appears in the data stream on line 14, another write pulse is sent to RAM 34 which stores the NML word at its input in the second section of RAM 34 (still corresponding to that particular pulse beat), and causes a compare condition to exist at comparator 44 which causes sub-counter 37 to be reset. Additionally, a pulse is developed on line 56 which is gated with the enabling latched signal on line 58 from comparator 60 so as to produce a key-down pulse on line 62 in a time slot corresponding to the second key which is depressed as the keyboard is scanned from top to bottom. Demultiplexer 64 produces the appropriate parallel form data for transmission to the keyers (not shown).

It should be noted that the three bit binary word stored in the first section of RAM 34 corresponds to an absolute address on the keyboard, as does the three bit MSB word stored in MSB RAM 36. However, the three bit words stored in the second, third and fourth sections of RAM 34 do not correspond to absolute addresses but, rather, each represents the number of keys in the interval between the keys stored in the previous section and the key presently being stored. This results in substantial economy of RAM storage capacity yet does not present an undue limitation to the performer since it is unusual for adjacent notes in a chord to be spaced more than seven keys.

When the third depressed key is encountered by the multiplexer 12 and a pulse appears on line 14, random access memory 34 will store the three bit binary word NML corresponding to the number of time slots between the presently multiplexed key and the previous key. This word will be stored in the third section of the memory 34 corresponding to the particular rhythm beat which is present at that time. Again, comparator 44 will produce a pulse on line 46 which will be gated by circuit 66 and fed to demultiplexer 64. Sub-counter 37 will be reset to produce the binary word 000 in synchronism with the next pulse from the master counter. Similar storage and playing is accomplished for the fourth note of the chord, assuming that a four note chord is played. Of course, if a single note is played during the rhythm beat, only the first section of RAM 34 will be loaded and the second, third and fourth sections will remain empty (111) thereby denoting a "no note played" condition. When accompanied by a valid MSB word other than binary 000, an LSB word 111 conveys the interval information previously described. When the MSB word is 000, an LSB word of 111 denotes "no note played."

Record lockout 54 prevents any further data from being entered in MSB RAM 36 after the first word is stored. Data gating circuit 66 performs a similar function with respect to any additional output pulses being transmitted to demultiplexer 64 after the record scan (or play scan in the playback mode) has been completed. A binary 111 in the subcounter with a valid MSB word (other than binary 000 ) will also lockout any additional data by means of the 111's lockout 65. This is encountered the first time an interval of eight or more notes exists after a stored LSB word.

In the playback mode, which is initiated on the fifth downbeat signal received after record button 16 is depressed, read signals are constantly fed to RAMs 34 and 36 by record control gating circuit 24. When comparators 44 and 60 detect compare conditions between the outputs of RAMs 34 and 36, which are being addressed by the five bit ABCDE counts from rhythm counter 22 and the HGF and NML addresses from the master counter and sub-counter 37, respectively, output pulses in the appropriate time slots will be provided to the demultiplexer 64. This results in the stored passage which was recorded during the record mode being played by the organ.

Turning now to FIG. 2, rhythm counter 22 comprises a 74161 counter 68 which is clocked by rhythm clock 70 to produce a four bit binary count ABCD. JK flip-flop 72 is clocked by counter 68 to produce the E bit thereby forming a five bit binary count which is sequenced from counts 1 through 32.

For certain rhythms, it is desireable for the timing to be $\frac{3}{4}$ time rather than 4/4 time. This necessitates the deletion of eight counts in the sequence and is accomplished by the decoding of the D, C and A outputs of counter 68, strobed by the rhythm count 1. When a $\frac{3}{4}$ enable signal is present on line 74, binary counts 7, 8, 15, 16, 23, 24, 31 and 32 are deleted for two measures thereby producing a total of 24 counts which is compatable with $\frac{3}{4}$ time.

Figures 3A, 4:
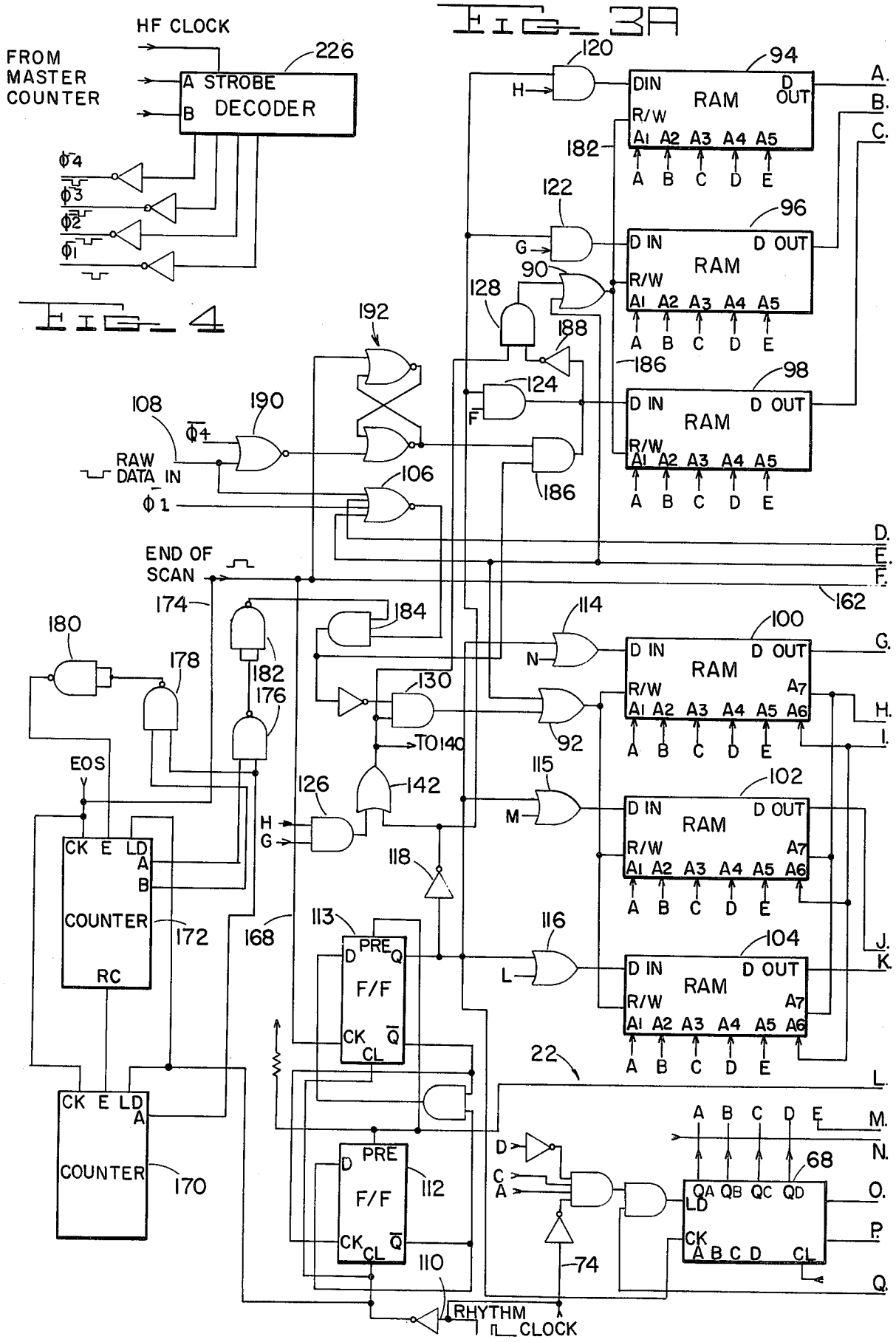
FIGS. 3A and 3B together comprise a more detailed schematic diagram of the system illustrated in FIG. 1.
FIG. 4 is a schematic diagram showing the generation of the four phase clock pulses which provide for timing of the system shown in FIGS. 3A and 3B.
Figure 3B:
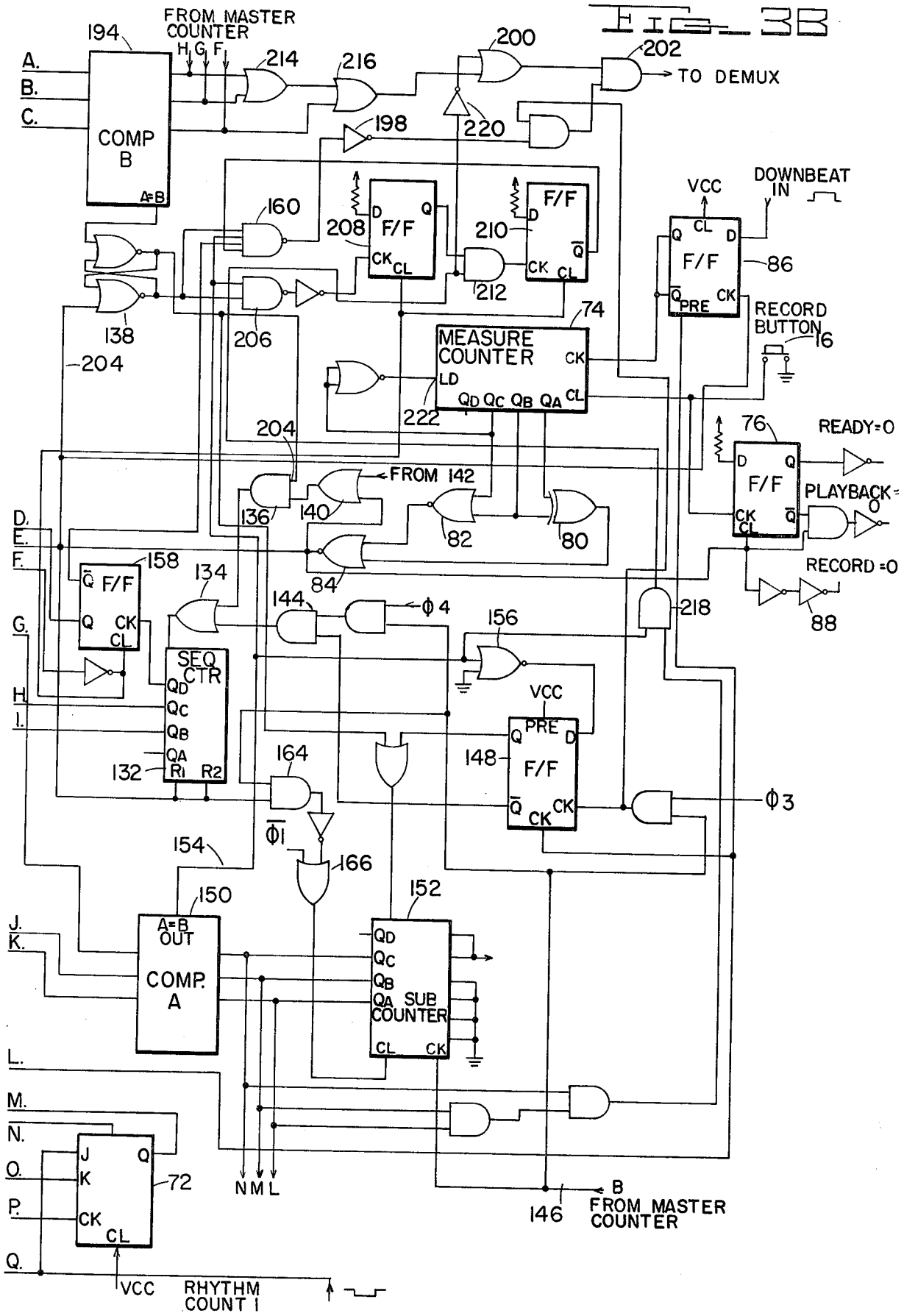

Referring now to FIGS. 3A and 3B, the circuitry forming the block system illustrated in FIG. 1 will be described. To bring the system into operation, record button 16 is momentarily depressed thereby clearing measure counter 74 and clocking flip-flop 76 so as to activate the "ready" lamp (not shown) which is controlled by the signal at the output of inverter 78. Only the ready lamp is activated at this time because the decode gating comprising exclusive OR gate 80 and NOR gate 82 do not indicate a write (record) condition, which would be a logic 0 on the output of OR gate 84 connected to the clear input of flip-flop 76.

Measure counter 74 then counts downbeats coming through flip-flop 86, the downbeats occurring once per measure on the very first count thereof. Counter 74 is incremented until it reaches binary 3, that is, the $Q_A$ and $Q_B$ outputs being at logic 1's, at which time the system enters the record mode by virtue of a logic 0 at the output of OR gate 84. The logic 0 at the output of OR gate 84 clears flip-flip 76 so as to activate the "record" lamp (not shown) controlled by the signal on the output of inverter 88.

The system is in the record mode when measure counter 74 is in binary states 3 and 4, which is during the third and fourth measures after the initial depression of record button 16. The logic 0 at the output of OR gate 84 enables OR gates 90 and 92 to pass write pulses to MSB random access memories 94, 96 and 98 and LSB random access memories 100, 102 and 104, respectively. It further enables NOR gate 106 to gate raw data in on line 108.

A rhythm clock pulse on line 110 clears D-type flip-flops 112 and 113. The end of scan pulse following the rhythm clock pulse updates them into the erase state which is Q equals 1 for flip-flop 112 and $\overline{Q}$ equals 1 for flip-flop 113. This erase condition will remain for one scan of the manual and results in loading logic 0's into MSB RAMs 94, 96 and 98 and loading logic 1's into LSB RAMs 100, 102 and 104, the latter occurring four times in the scan, one for each section of RAMs 100, 102 and 104. The system then waits 16 manual scans for each rhythm pulse before new information can be written into RAMs 94–104.

In the erase mode, an erase command of logic 1 on the Q output of flip-flop 113 forces a logic 1 on the outputs of OR gates 114, 115 and 116 so as to present logic 1 data to the data in inputs of LSB RAMs 100, 102 and 104. A binary address of 111 for LSB RAMs 100, 102 and 104 is interpreted as a no note played condition, unless there is a valid address other than binary 000 in MSB RAMs 94, 96 and 98, in which case binary 111 in the LSB RAMs signifies an interval in the first section that it appears. Thereafter, LSB words of 111 are interpreted as no note played conditions. In the erase mode, however, binary 111 in the LSB RAMs 100, 102 and 104 effects erasing of the memories when a write command is presented to the R/W inputs for the LSB RAMs 100, 102 and 104. The logic 1 at the Q output of flip-flop 113, by virtue of inverter 118, presents a logic 0 at the data in inputs for MSB RAMs 94, 96 and 98 via AND gates 120, 122 and 124. Logic 000 for MSB RAMs 94, 96 and 98 is interpreted as a no note played condition and therefore erases the appropriate sections of RAMs 94, 96 and 98 when a write pulse is presented to the R/W inputs thereof.

The erase data is written into RAMs 94–104 seventeen counts after the scan of the keyboard is initiated, which is when the G and H master counter bits presented to AND gate 126 are logic 0's. It should be kept in mind that the master counter, of which G and H are the most significant bits, is a down counter starting at count 63 and counting down to 0 so that at count 47, the actual write pulses are generated for the MSB RAMs 94, 96 and 98. This occurs through AND gate 128 and OR gate 90. For the LSB RAMs 100, 102 and 104, the erase gating is accomplished through AND gate 130 and OR gate 92.

Since the LSB RAMs 100, 102 and 104 store information relating to the time slot spacing between adjacent notes, each of their four sections for every rhythm beat must be erased one at a time under the control of the sequence counter 132. During the first quarter of the erase scan, no erasure occurs, but beginning with count 47, the first sections of the LSB RAMs 100, 102 and 104 have logic 1's written into them after which the sequence counter is incremented to select the second section of the RAMs 100, 102 and 104. Incrementing of sequence counter 132 is accomplished by the following process. Clock commands to sequence counter 132 are enabled by OR gate 134 which in turn is enabled by AND gate 136 when an erase sequence enable command from flip-flop 138 and an enable command from OR gate 140 or a record sequence enable command and from flip-flop 138 is received thereby. OR gate 140 is controlled by an erase command from OR gate 142 and a write command from OR gate 84. The clock pulses gated by OR gate 134 come from AND gate 144 and are strobed by the master counter output B on line 146 during phase 4 time. The clock pulses are enabled in AND gate 144 by a command from the $\overline{Q}$ output of flip-flop 148 which is a latched condition of comparator 150 occurring at phase 3 time. Comparator 150 has an output of logic 1 whenever the three LSB RAMs outputs are binarily equivalent to the three outputs $Q_A$, $Q_B$ and $Q_C$ of sub-counter 152, which in the erase mode will be binary 111.

Each time sub-counter 152 reaches a binary 111 state, comparator 150 will detect a compare condition since in the erase mode, the collective output of RAMs 100, 102 and 104 is also binary 111. Comparator 150 places a logic 1 signal on line 154. This is gated by NOR gate 156 and is latched in flip-flop 148 which, as was described earlier, sequences sequence counter 132. Sequencing of counter 132 occurs each time that comparator 150 detects a binary 111 at the output of sub-counter 152 during the erase cycle and results in LSB RAMs 100, 102 and 104 having logic 1's written into each of their four sections before actually going into the record cycle.

Erasure will occur for each of the four sections of the LSB RAMs 100, 102 and 104 at which time sequence counter 132 will clock a stop condition into the flip-flop 158 from the $Q_D$ output. This stop condition prevents further data out through NAND gate 160 and also prevents further raw data from being passed by NOR gate 106. Sub-counter 152 is cleared by the end of scan command on line 162 which is gated by AND gate 164 and OR gate 166 when the master counter output B is high and is strobed by the phase 1 clock. It will be recalled that the end of scan pulse is generated by decoding the master counter output.

With the erase cycle completed, the system will wait for sixteen further scans of the manual before going into the record or write mode. Writing of raw data into RAMs 94-104 is initiated by flip-flops 112 and 113 being clocked into the Q=1 state by the end of scan pulse on line 168, meaning erasure is over and that actual recording can take place. Counters 170 and 172 were initialized by the leading edge of the rhythm clock pulse on line 110 and are incremented by the end of scan pulse on line 174 until at the end of the seventeeth scan, which is decoded by gates 176, 178 and 180 and inverted by NOR gate 182, to enable AND gate 184 to permit raw data to be gated therethrough to the write command lines 182, 184 and 186 via AND gate 186 inverter 188, AND gate 128 and OR gate 90.

The MSB RAMs 94, 96 and 98 are written into by presenting logic 0's on the read/write inputs. Raw data in, which comprises keydown signals in a time division multiplexed data stream, passes through OR gate 190, RS latch 192 and is enabled for only one scan by AND gate 184, as was the write command for the three LSB RAMs 100, 102 and 104. The raw data in is strobed during phase 1 time in NOR gate 106 and generates the appropriate write pulses through AND gate 184. RS latch 192 is utilized to prevent any further writing of data into the MSB RAMs 94, 96 and 98 after the first bit of data is written in in one manual scan.

Comparator 194 will detect a compare condition between the three data outputs of MSB RAMs 94, 96 and 98 and the HGF bits from the master count. This compare condition is latched in flip-flop 138. Comparator 150 will also detect a compare condition when the sub-counter outputs LMN are equal to the outputs of RAMs 100, 102 and 104 and will gate its output pulse through NAND gate 160 together with the latched enable condition produced by comparator 194 and flip-flop 138.

Sequence counter 132 addresses the four sections of RAMs 100, 102 and 104 in the same manner as during the erase cycle. A logic 0 at pin 204 of AND gate 136, which signal is generated by latch 138 after the first bit of data is stored in MSB RAMs 94, 96 and 98, enables the clocking of sequence counter 158. This occurs immediately after writing data into the MSB RAMs 94, 96 and 98 so as to increment sequence counter 132 by one place. This in turn addresses the second sections of RAMs 100, 102 and 104 for the same rhythm beat. When the next pulse appears on the data stream, representative of the second highest key depressed, a write command will be transmitted through OR gate 92 to the R/W inputs of LSB RAMs 100, 102 and 104 so that the NML count from sub-counter 152 will be stored. This represents the interval between the highest and next highest note pl· yed.

Sub-counter 152 will be cleared and sequence counter 132 advanced so that RAMs 100, 102 and 104 are now ready to store the next data word in the third section corresponding to the same rhythm beat, which word will be determined by the count of sub-counter 152 which has just started over at binary 000. In a similar fashion, the third and fourth pulses on the data stream will cause the respective NML sub-counter counts to be stored in RAMs 100, 102 and 104 in the third and fourth sections, respectively, pertaining to the same rhythm beat. Sequence counter 132 will advance to address the third sections of RAMS 100, 102 and 104 to ready them for the arrival of the third data pulse, and will address the fourth sections thereof to ready them for the arrival of the fourth pulse in the data stream.

Each time that a new word is stored in LSB RAMs 100, 102 and 104, comparator 150 will generate a pulse which will be gated to demultiplexer 64 through AND gate 160, which is enabled by the latched compare condition of flip-flop 138. At the end of the scan, the EOS pulse on line 204 will reset flip-flop 138 thereby preventing the further passage of data to multiplexer 64. Flip-flop 158 also inhibits gate 160 when the $Q_D$ output is at logic level 1. Sub-counter 152 is cleared by the end of scan command. NAND gate 206 works together with NAND gate 160 to lockout any output pulses from demultiplexer 64 due to binary 111 in the LSB RAMs (except for the first interval of 111 in the LSB RAMs accompanied by a number other than 000 in the MSB RAMs).

With the receipt of the next rhythm clock pulse on line 110, the aforementioned sequence repeats itself including the erase and record cycles. On this beat, however, RAMs 94, 96, 98, 100, 102 and 104 are addressed by the rhythm count ABCDE pertaining to the second rhythm beat rather than the first beat. The same process is repeated 32 times in total as the rhythm count advances from binary 00000 to binary 11111.

In the case that no data is presented at the raw data input on line 108 during the record cycle, the LSB RAMs 100, 102 and 104 will present logic 1's on their output to comparator 150 and the sub-counter 152, which sequences 0 through 7 will have a comparison to create an output logic 1 for every state 7 of the sub-counter, that is, binary 111 on $Q_A$, $Q_B$ and $Q_C$. To prevent this from appearing as data, RS flip-flop 138 will not allow the pulse to be put out as data, since no data has been written into the MSB RAMs 94, 96 and 98. It will be recalled that comparator 194 will provide a "no compare" signal to flip-flop 138 until the first data pulse appears on the data stream.

In the case where comparator 150 provides a compare pulse on line 154 and flip-flop 138 is set indicating that data has been stored in the MSB RAMs 94, 96 and 98, binary 111 in the LSB RAM would in this special case be allowed to generate data. However, succeeding comparisons of binary 111 on the sub-counter 152 with binary 111 from the LSB RAMs 100, 102 and 104 will not generate data through the action of latches 208 and 210. Latch 208 contains the information that the first note in a string of notes of one or more has already been latched in by virtue of the output from NAND gate 206. This information is combined in AND gate 212 with information indicating that a count of binary 111 was compared in comparator 150 with the three LSB RAM outputs and that an output pulse was generated. These two bits of information are latched into latch 210. This disables AND gate 160 to prevent any further data pulses to be passed. This feature limits the playing of chords to a span of 7 notes from one note to the next. Otherwise, the first interval that exceeded seven notes would cause no further notes to be either recorded or played back.

Another case where prevention of data must occur is when no data is being recorded for a particular rhythm count, thereby causing the outputs of the MSB RAMs 94, 96 and 98 to be binary 000. The outputs of the LSB RAMs 100, 102 and 104 will be binary 111 and comparators 150 and 194 will generate a bit of data at count 0 of the master counter. This data is prevented from going out to demultiplexer 64 through gate 200 by the detection of binary 000 for the FGH bits of the master counter through OR gates 214 and 216, through AND gate 218 and inverter 220.

The system goes into the playback mode on the fifth downbeat counted by measure counter 74 following the depression of record button 16. Counter 74 sets up a condition at its load input 222 so that when the next clock pulse to the counter arrives, i.e. the synchronized downbeat, the counter 74 will be preloaded to a binary 13 which is $Q_A=1$, $Q_B=0$, $Q_C=1$ and $Q_D=1$. Counter 74 locks up in this state until receiving a clear command from the record button for a future recording session. At this time, the playback lamp (not shown) will be activated by the signal at the output of inverter 224 and there will be a logic 1 at the output of OR gate 84. This will cause a read signal to be supplied to the R/W inputs of RAMs 94, 96, 98, 100, 102 and 104 and will result in HGF and NML data words being supplied to comparators 194 and 150, respectively, as RAMs 94–104 are addressed by the ABCDE count from rhythm counter 22 and as LSB RAMs 100, 102 and 104 are addressed by sequence counter 132. Thus, the entire sequence of data stored in the RAMs 94–104 will be read out in synchronism with the rhythm counts so as to produce a serial data stream at the input to demultiplexer 64 with the identical timing and structure as the data stream appearing on line 108 during the record cycle. The playback cycle will repeat itself continuously and the data produced thereby will be gated externally by appropriate circuitry, for example AND gating, to allow or disallow this data from being transmitted to the demultiplexer 64. Thus, the performer can selectively determine at what points in the composition he will call for the playing of the two measure sequence stored in RAMs 94–104.

FIG. 4 illustrates the decoder 226 which receives pulses from the master counter and provides the four phase pulse trains utilized to strobe the system described above.

The following schedule identifies appropriate devices for many of the circuit elements shown in FIGS. 3A, 3B and 4:

| Reference Numeral | Device |
|---|---|
| 140, 92, 114, 115, 116 | OR gate 7432 |
| 138, 192, 190, 82, 156 | NOR gate 7402 |
| 112, 113, 148, 86, 158 | DUAL D edge flip-flop 7474 |
| 72 | DUAL JK flip-flop 7476 |
| 186 | 7408 AND gate |
| 106 | 7425 NOR gate |
| 132 | 7493 counter |
| 160 | 7420 NAND gate |
| ALL inverters | type 7404 |
| 194, 150 | 7485 comparator |
| 74, 152, 68 | 74161 counter |
| 94, 96, 98, 100, 102, 104 | 93410 random access memory |
| 202, 212, 218, 136, 164 | |
| 130, 184, 126, 120, 122, 124 | 7408 AND gate |
| 208, 210, 76 | 7474 DUAL D edge trigger flip-flop |
| 200, 216, 214, 140, 166, | |
| 142, 90 | 7432 OR gate |
| 170, 172 | 74191 counter |
| 180, 178, 176, 182 | 7400 NAND gate |

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains, and fall within the limits of the appended claims.

What is claimed is:

1. In an electronic organ having a keyboard with playing keys and multiplexer means for scanning said keyboard and developing a multiplexed serial input data stream having keydown signals in time slots corresponding to depressed keys of said keyboard, the improvement being a programmable note pattern generator having a record mode and a playback mode and comprising:

counter means for producing a count sequence in synchronism with the scanning of the keys of said keyboard a programmable memory, record means responsive to said input data stream for writing in said memory data corresponding to said keydown signals in said input data stream, said record means being operable when said pattern generator is in the record mode, playback means for reading the data stored in said memory in the same order in which it was written into said memory, and comparator means for producing a keydown signal in an output data stream each time there is a match between said count and the data read out of said memory.

2. The note pattern generator of claim 1 wherein said multiplexer means scans said keyboard continously and develops a continuous input data stream comprising input keydown signals in time slots corresponding to keys which are currently depressed, and including: rhythm generator means for producing a stream of rhythmic timing signals at a rate much slower than the rate at which said keyboard is scanned, and means for addressing successive locations of said memory in synchronism with the timing signals and for writing in said locations data corresponding to keydown signals in said continuous input data stream coincident with the respective timing signals.

3. The note pattern generator of claim 1 wherein said record means writes in said memory data corresponding to the time slot of the first occurring keydown signal in said input data stream and data corresponding to the intervals between at least some of successive keydown signals in said input data stream.

4. The note pattern generator of claim 3 wherein:

said data stream is divided into a plurality of successive multiple time slot segments, said memory comprises first and second random access memories, said record means writes in said first and second random access memories data corresponding to the absolute time slot address of the first occurring keydown signal.

5. The note pattern generator of claim 4 wherein said input data stream contains at least two keydown signals and said record means writes in said second random access memory data corresponding to the interval between the first and second occurring keydown signals in said input data stream, said last mentioned data being in terms of time slots in said input data stream separating said first and second occurring keydown signals.

6. The note pattern generator of claim 4 wherein the count sequence produced by said counter means is a series of binary words having most significant bits and least significant bits, and the data corresponding to the segments of the input data stream comprises the most significant bits of a selected count of said counter means.

7. The note pattern generator of claim 6 including a resettable sub-counter clocked in synchronism with said counter means, and the data corresponding to the intervals between the successive keydown signals are selected counts produced by said sub-counter.

8. The note pattern generator of claim 7 wherein:

said first and second random access memories have outputs, said comparator means includes: a first comparator having one set of its inputs connected to the outputs of said first random access memory and its other set of inputs fed by the most significant bits of the count sequence produced by said counter means, and a second comparator having one set of its inputs connected to the outputs of said second random access memory and its other set of inputs fed by the counts produced by said sub-counter.

9. The note pattern generator of claim 8 wherein said comparators have outputs, and including means for gating said comparator outputs together so as to produce said output data stream.

10. In an electronic organ having a keyboard with playing keys and multiplexer means for scanning the keyboard and developing a multiplexed data stream comprising time slots for the respective keys of the keyboard and a plurality of input keydown pulses in respective said time slots corresponding to a plurality of depressed keys of said keyboard, the improvement being a programmable chord pattern generator having record and playback modes and comprising:

a programmable memory, record means responsive to said input serial data stream for writing in said memory data corresponding to the time slot of the first occurring input keydown pulse in the input data stream and the data corresponding to the interval between the first occurring pulse and the second occurring pulse in the data stream, said record means being operable when said chord generator is in the record mode, and playback means for reading the data stored in said memory and developing an output serial data stream comprising time slots for the respective keys of said keyboard and output keydown pulses in the time slots in said output data stream corresponding to the data read out of said memory.

11. The chord pattern generator of claim 10 wherein said multiplexer means scans said keyboard continuously and develops a continuous input data stream comprising input keydown signals in time slots corresponding to keys which are concurrently depressed, and including: rhythm generator means for producing a stream of rhythm timing signals at a rate much slower than the rate at which said keyboard is scanned, and means for addressing successive locations of said memory in synchronism with said timing signals so as to cause said record means to write into the successive locations of said memory data corresponding to the keydown pulses present in the input data stream coincident with the respective timing signals.

12. The chord pattern generator of claim 11 wherein said rhythm generator means produces a series of multiple bit binary counts in synchronism with the timing signals and said memory is addressed by said counts.

13. The chord pattern generator of claim 11 including means for selectively causing said chord pattern generator to go into the record mode for a predetermined number of rhythm timing signals and then automatically to go into the playback mode.

14. The chord pattern generator of claim 13 wherein said record includes means for automatically erasing the locations of said memory prior to writing data therein during successive rhythm beat periods defined by said rhythm timing signals.

15. The chord pattern generator of claim 10 wherein said input data stream contains at least four successive keydown pulses and said record means writes into said memory data corresponding to the intervals between respective said four successive keydown pulses, said intervals being in terms of time slots in said input data stream.

16. In an electronic organ having a keyboard, the method of memorizing and then playing back a musical passage comprising:

depressing a plurality of keys on the keyboard, scanning the keyboard to develop a time division multiplexed serial data stream having a unique time slot for every key of the keyboard and a plurality of signals in said time slots corresponding to the depressed keys, selectively writing into a programmable memory data corresponding to the location in the data stream of the first occurring keydown signal and then writing into said memory data corresponding to the respective intervals between at least some of the successively occurring keydown signals beginning with said first occurring keydown signal, reading the data stored in the memory, converting the data read out of the memory to a serial time division multiplexed data stream having keydown signals in time slots uniquely corresponding to certain keys of the keyboard, and producing audible tones corresponding to said certain keys.

* * * * *